US005234396A

United States Patent [19]

Wilkinson

[11] Patent Number: 5,234,396

[45] Date of Patent: Aug. 10, 1993

[54] ADJUSTABLE STRETCHING STEP

[76] Inventor: William T. Wilkinson, Box 772, Crownsville, Md. 21032

[21] Appl. No.: 917,948

[22] Filed: Jul. 24, 1992

[51] Int. Cl.[5] ..... A63B 17/00

[52] U.S. Cl. ..... 482/142; 297/423.46; 248/396; 482/52

[58] Field of Search ..... 248/396, 677, 439; 297/439; 108/1; 482/51, 52, 142

[56] References Cited

U.S. PATENT DOCUMENTS

| | | | |
|---|---|---|---|
| 2,566,498 | 9/1951 | Rivercomb | 297/439 |
| 2,912,046 | 11/1959 | Fuerst | 297/439 |
| 3,121,551 | 2/1964 | Ancell et al. | 297/439 |
| 3,160,381 | 12/1964 | Langbaum | 297/439 |
| 4,296,694 | 10/1981 | Kobayashi | 297/439 X |
| 5,118,101 | 6/1992 | Belli | 482/52 |
| 5,127,647 | 7/1992 | Wilkinson | 482/52 |

FOREIGN PATENT DOCUMENTS

| | | | |
|---|---|---|---|
| 694008 | 7/1940 | Fed. Rep. of Germany | 297/439 |
| 1102922 | 2/1968 | United Kingdom | 108/1 |

*Primary Examiner*—Gene Mancene
*Assistant Examiner*—L. Thomas
*Attorney, Agent, or Firm*—Charles S. Knothe

[57] ABSTRACT

A stretching step with a perimeter skirt circumscribing the platform and the height of one end of the platform can be varied by means of cylinders formed in the platform and telescoping legs which interact with the cylinders and are positioned by spring lock pins and holes in the cylinders or an alternated means to vary the height by means of a plurality of holes in the opposite sides of the perimeter skirt and a U-bar that is inserted in corresponding holes and rest in notches in the bottom edge of the perimeter skirt to obtain different height adjustments.

1 Claim, 8 Drawing Sheets

ADJUSTABLE STRETCHING STEP

BACKGROUND OF INVENTION

Jogging and running are popular forms of aerobic exercise. Prior to running joggers perform stretching exercises to reduce muscle injuries. In particular they stretch the muscles in their feet, ankles, lower legs and thighs. Many joggers perform straight knee stretches. In a straight knee stretch they stand two or three feet away facing a wall or other solid structure. With their feet pointed straight toward the wall they lean forward and place their palms on the wall. They lift one heel from the ground by bending that knee and they keep the other foot flat on the ground and keep their knee, hip and back straight. They lean forward by bending their elbows until their calf becomes taut, hold for 2 to 20 seconds, relax and repeat. This device discloses a platform which assists and augments the jogger in his stretching exercises. With the device the jogger stands on the platform and pushes against the wall as in a conventional stretching exercise. But with this device the angle of the platform surface can be varied thereby increasing the amount of stretching that can be obtained.

This device can also be used for toe raises, stretching the calf muscles and developing the Achilles tendons. Further it can also be used as a step climbing exerciser. The device is economical and light weight and can easily be carried with the jogger's normal gear.

SUMMARY OF THE INVENTION

This invention discloses a stretching step with a platform and a perimeter skirt around the outer edge of the platform. A plurality of stabilizers are attached perpendicularly to the bottom edge of the perimeter skirt. At one end of the platform is a means of adjusting the height. One means for adjusting the height is a plurality of cylinders formed within one end of the platform perpendicular to the top surface of the platform. A plurality of telescoping legs slide within these cylinders and each cylinder contains a plurality of holes which interact with a spring lock pin on each leg. The length of the legs are varied by use of the spring lock pins which adjusts the angle of the platform. Another means for adjusting the height is a U-bar which engages corresponding holes from a plurality of holes in opposite sides of the perimeter skirt wherein the U-bar rests in notches in the bottom edge of the perimeter allowing for the height adjustment. The top surface of the platform can be textured.

DETAILED DESCRIPTION OF THE DRAWINGS

Figure 1:
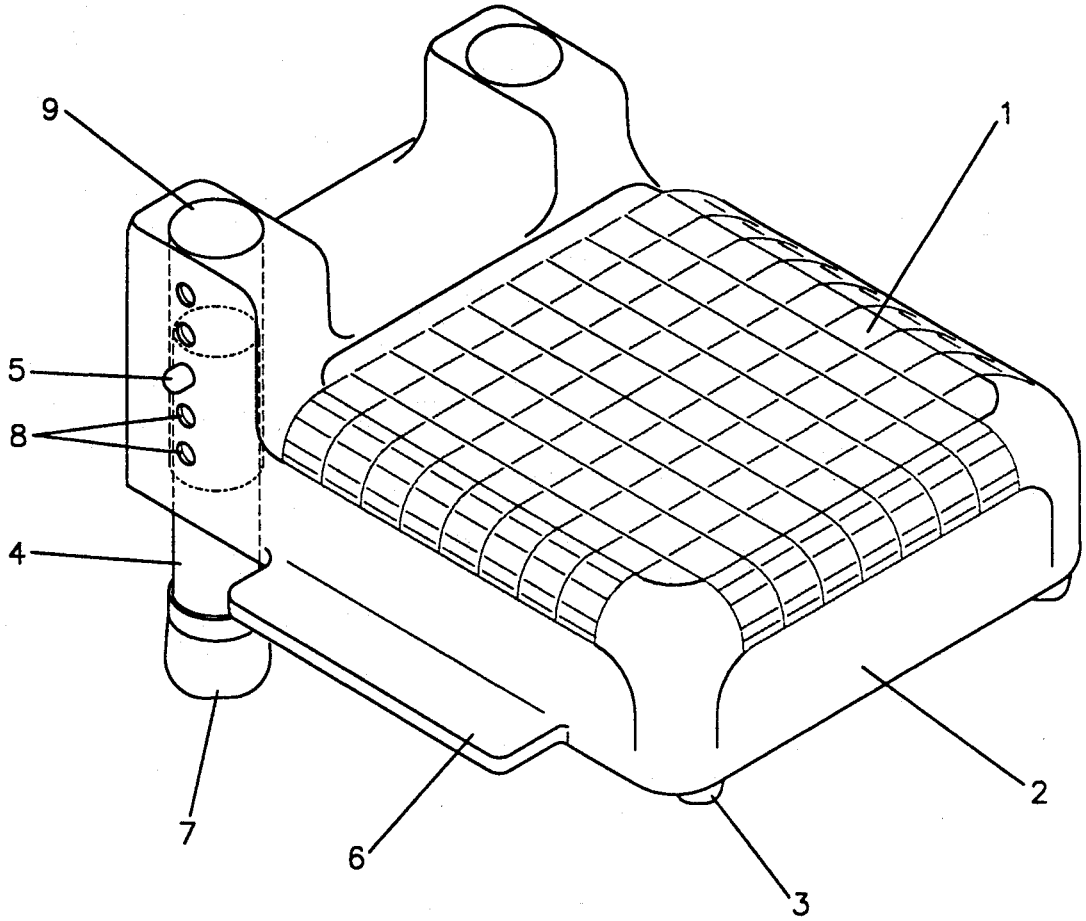
FIG. 1 is a perspective view of the device with the telescoping legs.

FIG. 1 shows the device in a perspective view. The platform 1 is large enough to stand on with both of the exerciser's feet. The perimeter skirt 2 is perpendicular to the top surface of the platform 1 and circumscribes the entire platform. This skirt establishes the fixed height of the platform. Non-skid feet 3 may be attached to the bottom of the perimeter skirt 2. The telescoping legs 4 fit into a cylinder 9 in the platform 1. The cylinders 9 for the legs 4 are located at opposite sides at one end of the platform and extend above the surface of the platform 1 to give the legs 4 more stability. A spring loaded lock pin 5 interacts with plurality of holes 8 in the cylinders 9 and positions the legs 4. The plurality of holes 8 in the cylinder allows the exerciser to select a variety of heights for the end of the platform. Each height adjustment allows the platform surface to have a different angle.

FIG. 1 also shows the stabilizers 6 which are attached perpendicularly to the side of the perimeter skirt 2. These stabilizers increase the resistance of the platform to tipping. This figure also shows the non-skid feet 7 attached to the end of the telescoping leg 4.

Figure 2A:
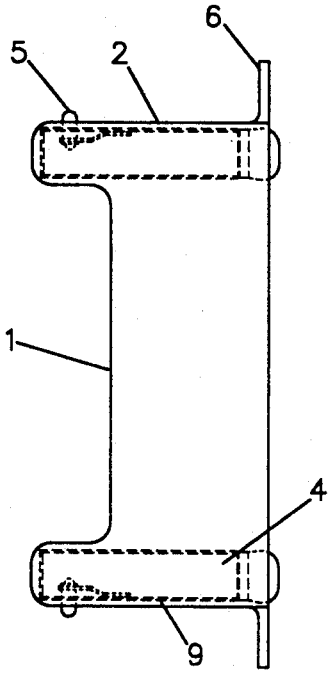
FIG. 2*a* is front view.

FIG. 2*a* is a front view of the device with the telescoping legs 4 retracted in the cylinder 9. In the preferred embodiment the device has two legs. This view also shows the spring loaded lock pin 5 which interacts with the holes in the cylinder 8.

Figure 2B:
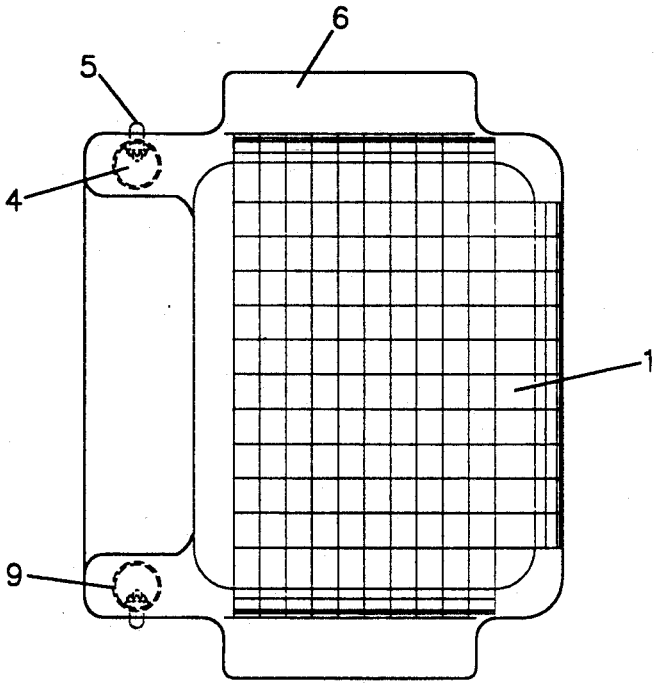
FIG. 2*b* is a top view.

FIG. 2*b* is a top view of the device. This view shows the location of the two legs 4 at the corners of one end of the platform 1. Each leg contains a lock pin 5.

Figure 2C:
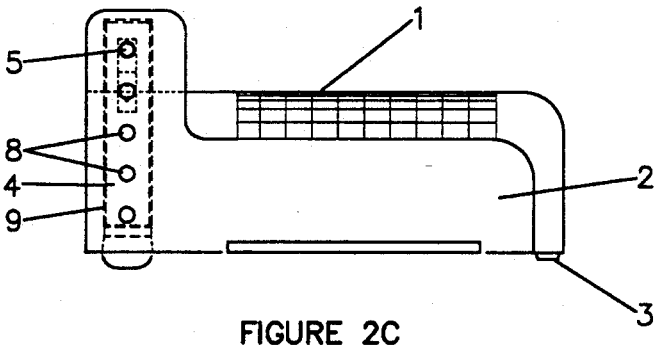
FIG. 2*c* is a left side view.

FIG. 2*c* is a side view of the device. This view shows the cylinder 9 extending above the level of the platform 1. This additional height adds strength to the cylinders 9 and allows a greater range of adjustment for the legs 4.

Figure 3:
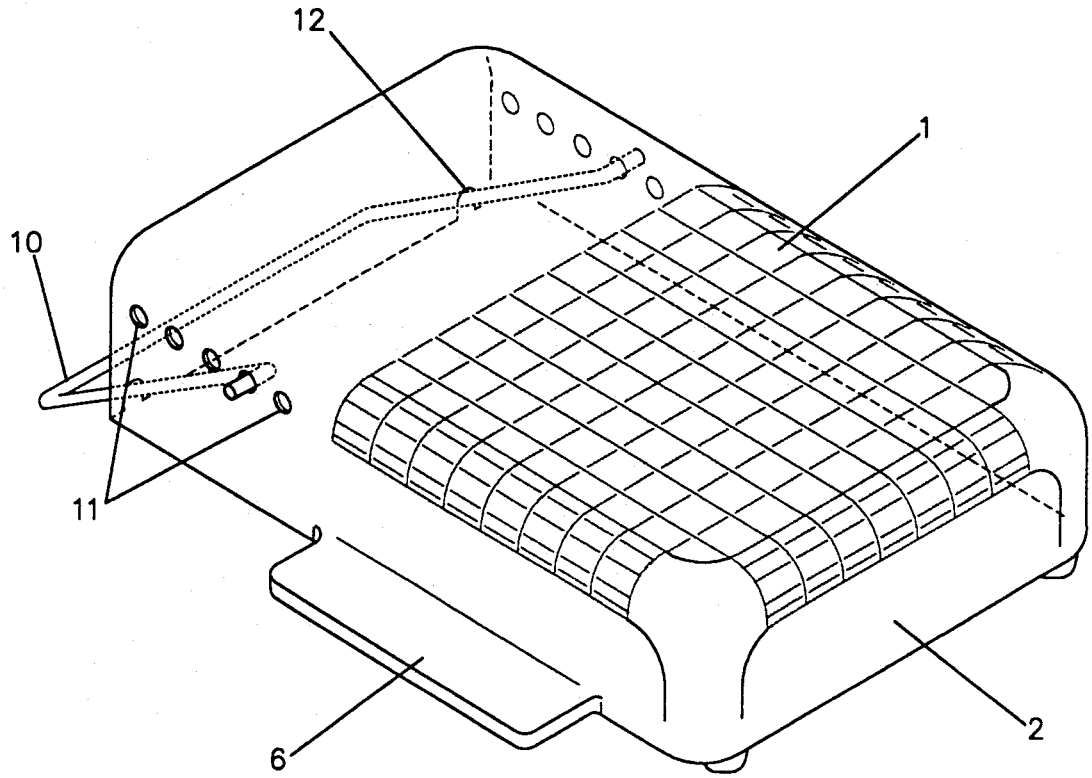
FIG. 3 is a perspective view of the device with the U-bar to adjust the height of one end of the platform.

An alternate means to adjust the angle of the platform 1 is shown in FIG. 3. In this embodiment a U-bar 10 interacts with corresponding holes 11 in the opposite sides of the perimeter skirt 2. The U-bar 10 rests on the notches 12 in the perimeter skirt 2. By placing the U-bar 10 in different corresponding holes 11 the height of the platform is varied.

Figure 4:
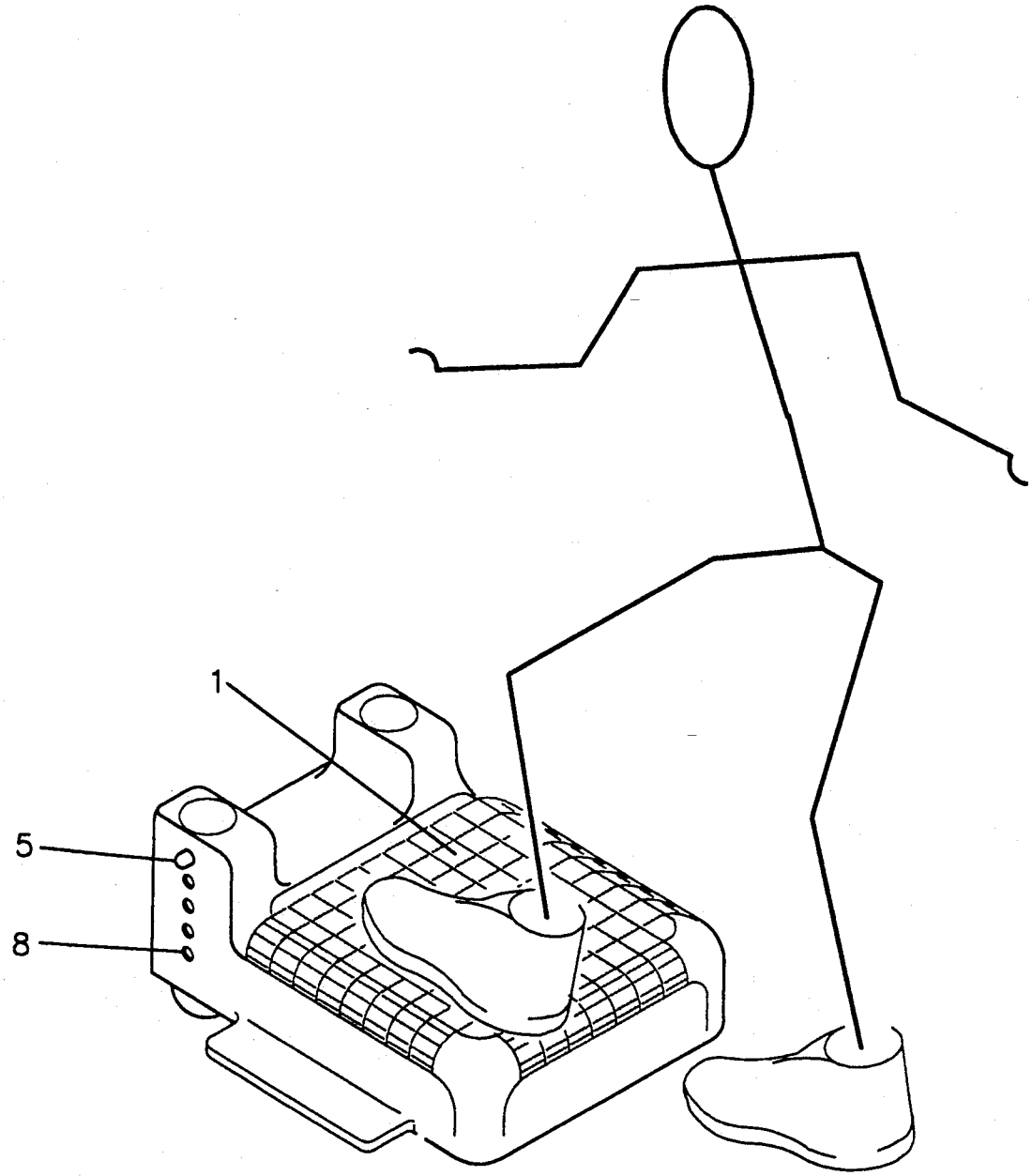
FIG. 4 is a perspective view showing an exerciser using the platform parallel with the ground for a stepping exercise.
Figure 5:
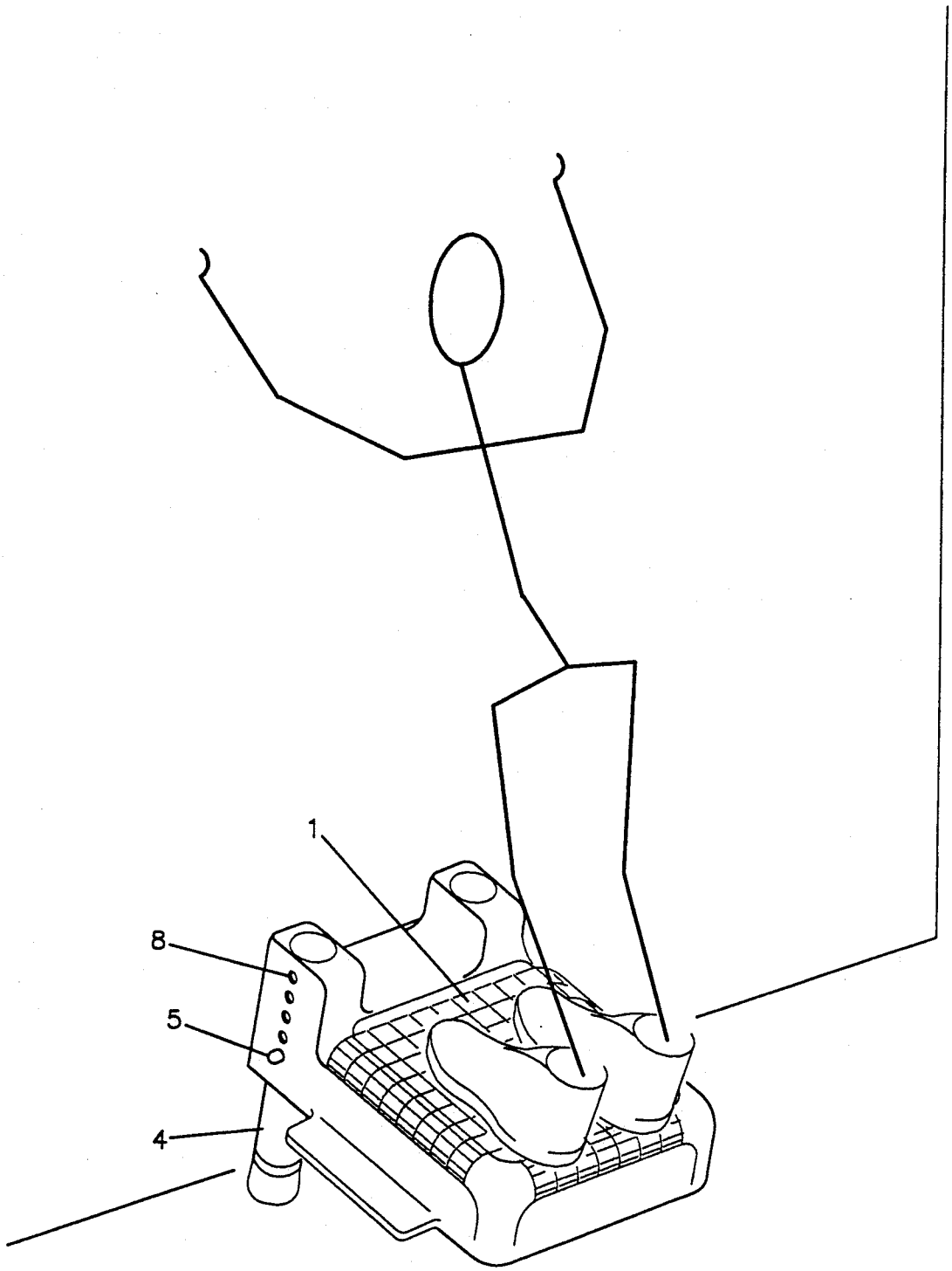
FIG. 5 is a perspective view showing an exerciser pushing against a wall and standing on the device with one end elevated.

FIG. 4 shows an exerciser stepping on the platform 1. The legs 4 are retracted and the lock pin 5 is in the upper most hole 8. In this configuration the platform is level with the sub-surface. FIG. 5 shows the exerciser with both feet on the platform 1. In this figure the legs 4 are extended and the lock pin 5 is in the bottom hole 8. In the configuration the platform has the maximum angle from the sub-surface.

Figure 6:
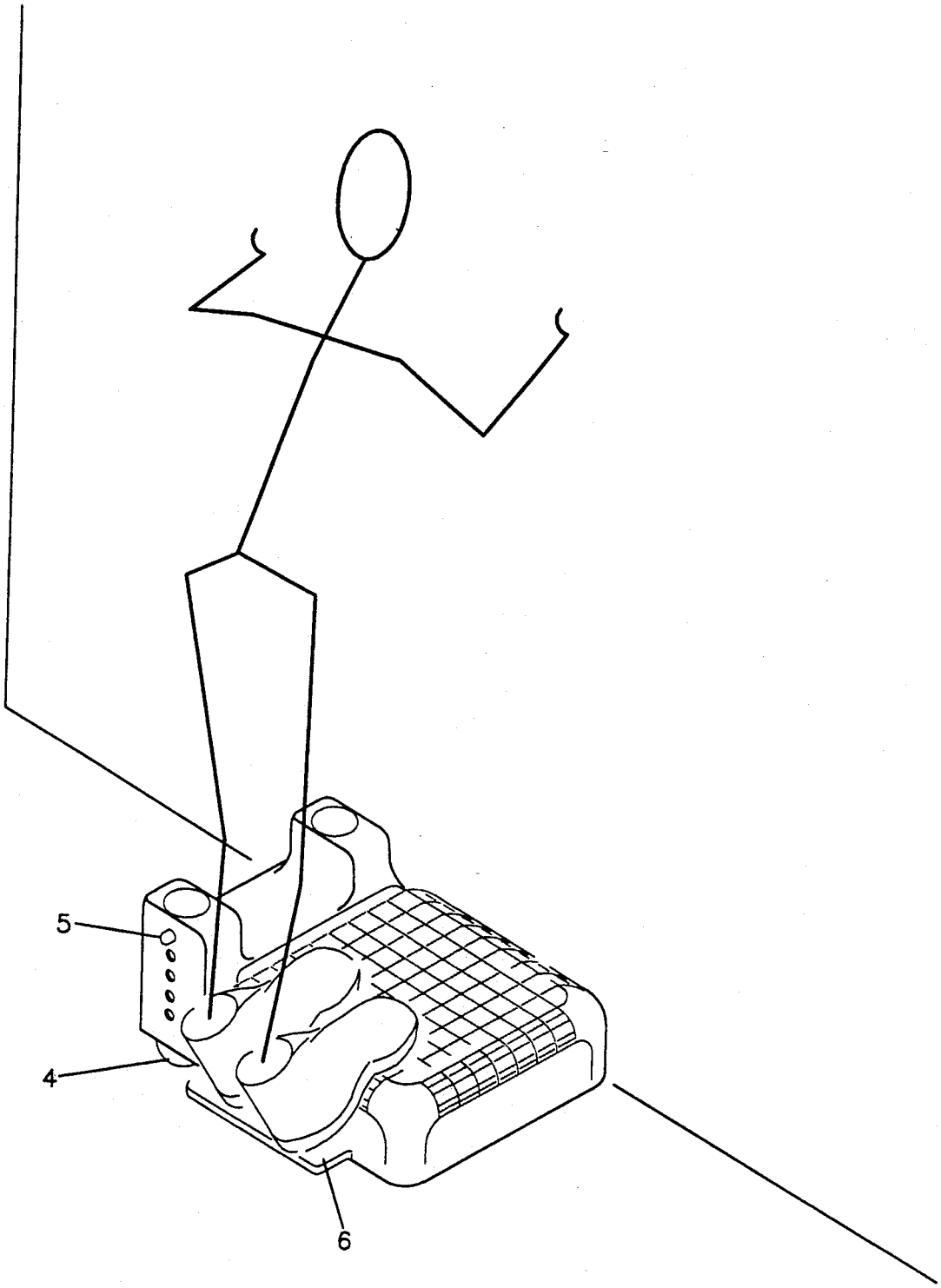
FIG. 6 is a perspective view showing an exerciser pushing against a wall with his arms and standing with the ball of his foot on the platform and the heel of his foot on the stabilizer.
Figure 7:
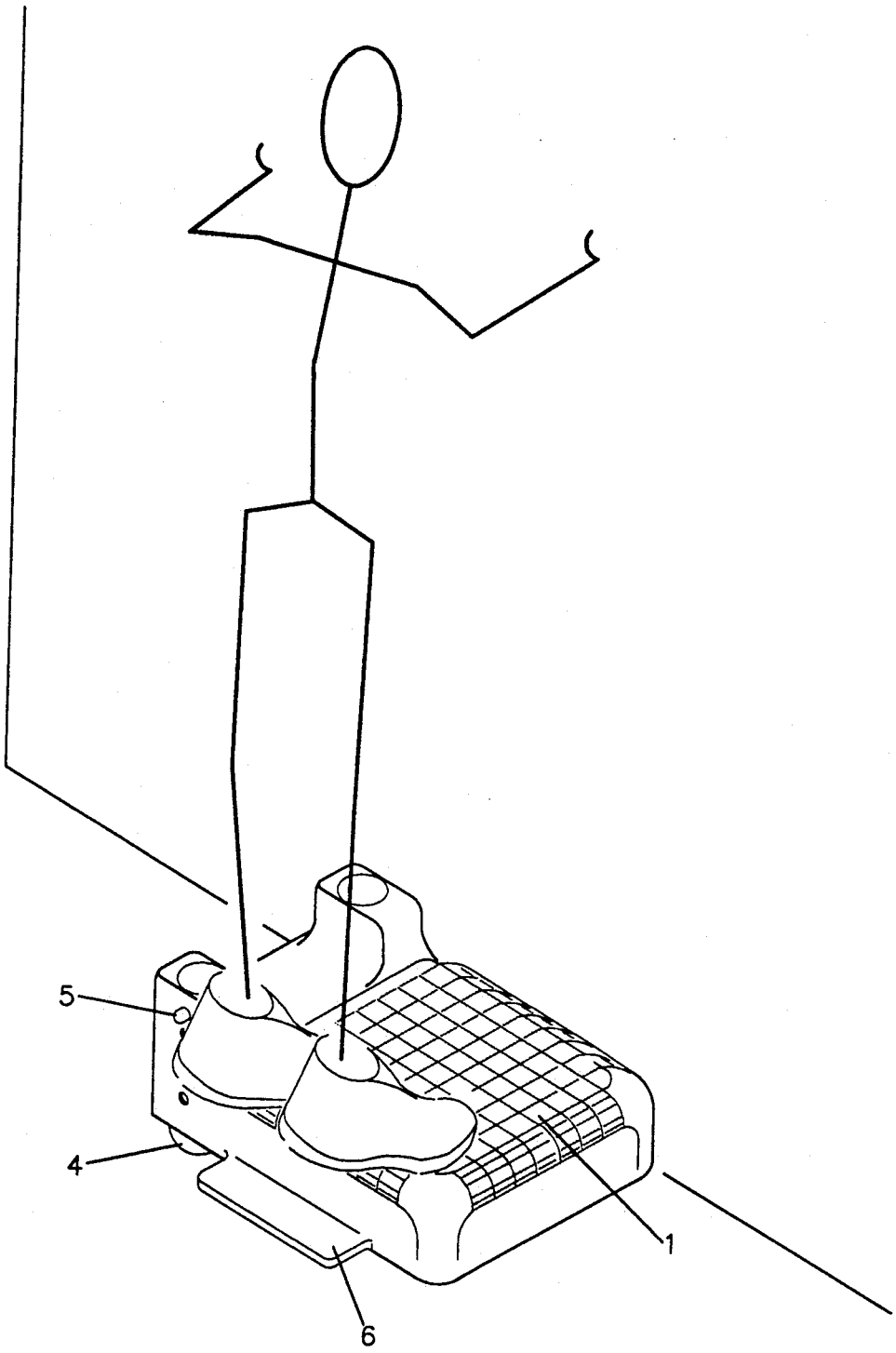
FIG. 7 is a perspective view showing an exerciser pushing against a wall with his arms and standing on his toes on the top of the platform.

FIG. 6 depicts an alternate use of the platform. The legs 4 are retracted with the lock pin 5 in the upper most position. Here the exerciser places his toes on the platform and lets his heels down on the stabilizer 6. FIG. 7 shows the exerciser up on his toes in the same exercise as in FIG. 6.

Figure 8:
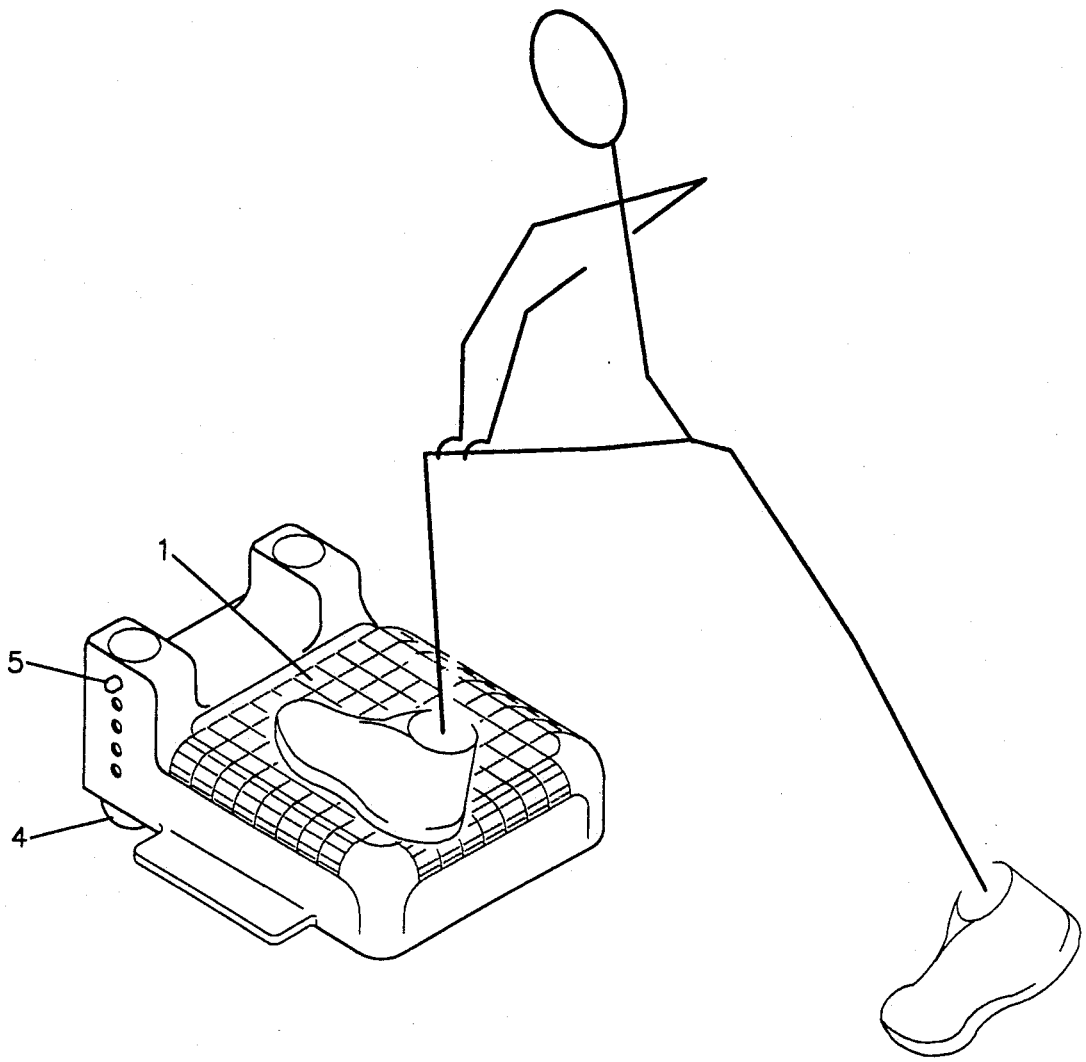
FIG. 8 is a perspective view showing an exerciser with one foot on the platform surface and the other leg in a trailing position.

The exerciser in FIG. 8 has one foot on the platform 1 and the other leg stretching to the rear.

What is claimed is:

1. I claim a stretching and aerobic climbing step comprising:

a platform with a perimeter skirt around the outer edge;

a plurality of notches in bottom edge of one side of perimeter skirt;

a plurality of holes on opposite sides of the perimeter skirt, the sides containing the holes being adjacent to side containing the notches;

a U-bar which engages corresponding holes on the opposite sides of the perimeter skirt such that the U-bar rests in the notches in the bottom edge of the perimeter skirt allowing for the adjustment of the platform height at one end.

* * * * *